US006101960A

United States Patent [19]

Ebata et al.

[11] Patent Number: 6,101,960

[45] Date of Patent: Aug. 15, 2000

[54] OVERLOCK SEWING MACHINE WITH MOVABLE CUTTER

[75] Inventors: Yoshikazu Ebata; Satoshi Maruo; Eiichi Shomura, all of Tokyo, Japan

[73] Assignee: Janome Sewing Machine Co., Ltd., Tokyo, Japan

[21] Appl. No.: 09/290,257

[22] Filed: Apr. 13, 1999

[30] Foreign Application Priority Data

Apr. 14, 1998 [JP] Japan ..... 10-102590

[51] Int. Cl.[7] ..... D05B 37/04

[52] U.S. Cl. ..... 112/122; 112/162; 112/129

[58] Field of Search ..... 112/162, 122, 112/122.1, 128, 129

[56] References Cited

U.S. PATENT DOCUMENTS

| | | | |
|---|---|---|---|
| 4,773,342 | 9/1988 | Fietta | 112/122 X |
| 5,289,789 | 3/1994 | Sakuma | 112/122 |
| 5,813,356 | 9/1998 | Nolle | 112/122 |

FOREIGN PATENT DOCUMENTS

| | | | |
|---|---|---|---|
| 3143479 | 6/1991 | Japan | 112/129 |

*Primary Examiner*—Ismael Izaguirre

*Attorney, Agent, or Firm*—Lowe Hauptman Gopstein Gilman & Berner

[57] ABSTRACT

An overlock sewing machine has a movable cutter which is activated in association with rotation of a main drive shaft to cooperate with a fixed cutter provided in the same plane with an upper surface of a needle plate, to thereby cut a work while the work is being stitched. A link mechanism includes a drive link having one end rotatably connected to a mount and the other end is connected to the movable cutter and a swingable link having an arcuate guide groove extending between one end and a center axis thereof around which the swingable link is swingingly moved. The drive link has a point between opposite ends thereof operatively connected to the arcuate guide groove of the swingable link. An operating device includes an operating shaft which is operatively connected to the point of the drive shaft so that the point of the drive link may be substantially moved along the arcuate guide groove of the swingable link between said one end and center axis thereof by manipulation of an operating knob. The drive link having the point thereof moved to one end of the swingable link will be swingingly reciprocated to activate the movable cutter, and having the point thereof moved to the central axis of the swingable link will move the movable cutter to an inoperative position below the needle plate where the movable cutter is held at standstill.

5 Claims, 4 Drawing Sheets

OVERLOCK SEWING MACHINE WITH MOVABLE CUTTER

BACKGROUND OF THE INVENTION

1. Field of the Invention

The invention relates to an overlook sewing machine, and more particularly relates to an overlook sewing machine having an operating device for switching a movable cutter of the sewing machine between an operative condition in which the movable cutter cooperates with a fixed cutter to cut a work while the work is being stitched and an inoperative condition below a needle plate in which the movable cutter is held at standstill with respect to the fixed cutter.

2. Description of the Prior Art conventional overlook sewing machine, it is necessary required to switch the movable cutter between the operative condition and the inoperative condition by manually holding and turning the cutter holder 180° with respect to the fixed cutter against a spring action which . is normally applied to the cutter holder. This switching operation is very troublesome. Moreover, even when the movable cutter is switched to the inoperative condition from the operative condition, the cutter unnecessarily removes when the sewing machine is driven.

OBJECTS OF THE INVENTION

It is, a principal object of the invention to provide an overlook sewing machine having an operating device which may be easily manipulated to switch the movable cutter between the operative condition and the inoperative condition with respect to the fixed cutter.

It is another object of the invention to provide an operating device which is simple in structure and reliable in operation.

It is another object of the invention to provide an operating knob which may be easily manipulated to switch the movable cutter between the operative condition and the inoperative condition.

It is still another object of the invention to hold the movable cutter at a standstill if the sewing machine is driven while it is switched to the inoperative condition from the operative condition.

BRIEF DESCRIPTION OF THE DRAWINGS

FIG. 1 (B) is a side elevational view of the essential part of the invention shown partly in cross section and showing another operation aspect of the mechanism;

FIG. 2 (B) is a substantially same view of the mechanism with that of FIG. 2(A), however, having a guide plate added thereto;

FIG. 3 (B) is a side elevational view of one element of the essential part of FIG. 3(A) shown partly in cross section to show the structure thereof;

FIG. 3 (C) is a perspective view of the essential part of FIG. 3(A) shown in an assembled condition;

FIG. 4 (B) is a side elevational view of the essential part of FIG. 3(C) shown partly in cross section and showing another operation aspect thereof; and FIG. 4 (C) is a side elevational view of the essential part of FIG. 3(C) shown partly in cross section and showing still another operation aspect thereof.

DETAILED DESCRIPTION OF PREFERRED EMBODIMENT

Figure 1:
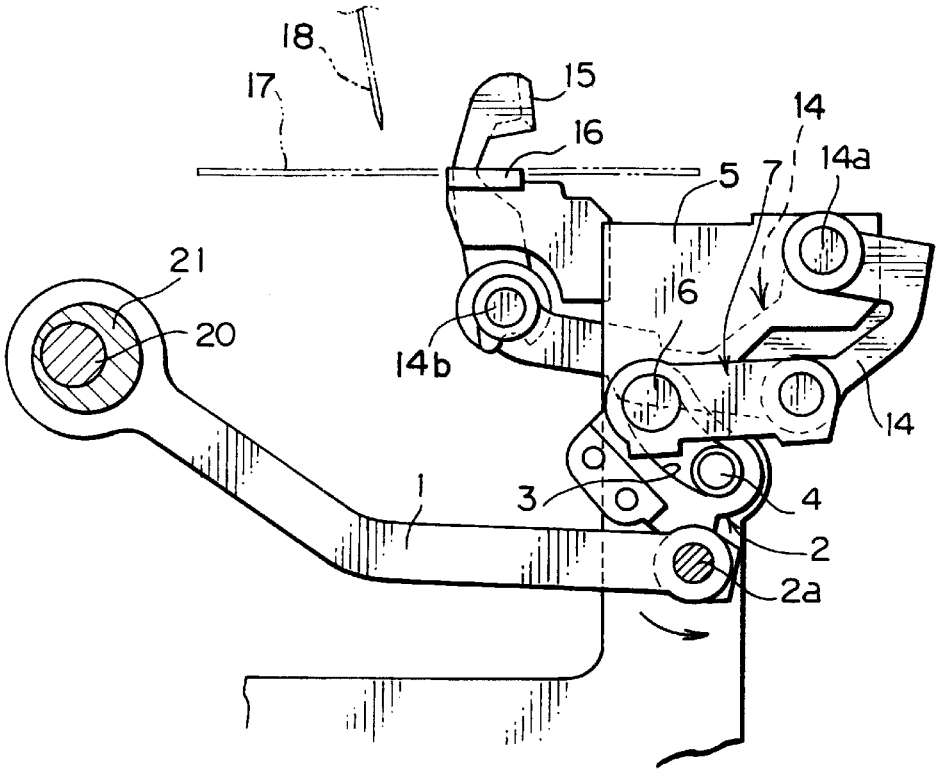
FIG. 1 (A) is a side elevational view of an essential part of the invention shown partly in cross section and showing one operation aspect thereof.
Figure 1:
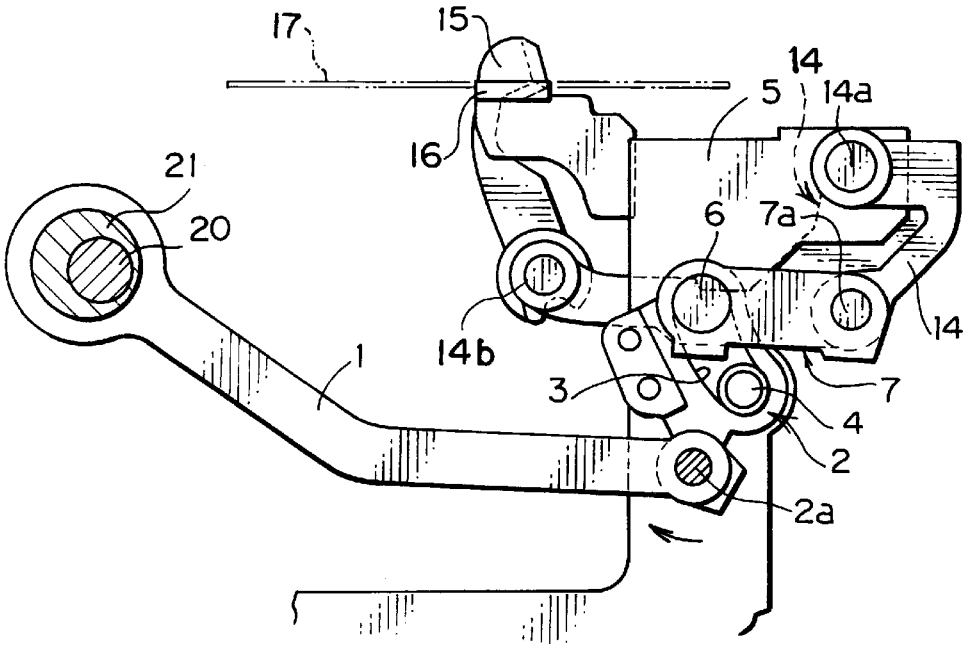

The invention will now be described with reference to a preferred embodiment. A drive mechanism for vertically moving an elongated movable cutter 15 relative to a fixed cutter 16 is shown in FIGS. 1(A) and (B) and FIGS. 2(A) and (B). A main drive shaft 20 has an eccentric cam 21 fixed thereto for rotation therewith. A transmission link 1 has one end engaging the eccentric cam 21 and the opposite end rotatably connected to a lower end of a swingable link 2 by means of a stud 2*a* so that the transmission link 1 may be laterally reciprocated when the main drive shaft 20 is rotated.

The swingable link 2 is moveable at the center thereof around a stud 4 on a mount 5. The swingable link 2 is, therefore, swingingly reciprocated in association with the lateral reciprocation of the transmission link 1. The swingable link 2 further has an arcuate guide groove 3 provided thereon, the arcuate guide groove 3 extending from the upper end of the swingable link 2 to the center thereof where there is the stud 4 on which the swingable link 2 is swingingly moved. A cutter drive link 14 has one end turnably connected to the mount 5 by means of a stud 14*a* and has the opposite end connected to the lower end of the elongated movable cutter 15 by means of a pin 14*a*. The movable cutter 15 has an edge formed at the top thereof. An intermediate link 7 has one end connected to generally a center portion of the cutter drive link 14 by means of a pin 7*a* and has the opposite end connected to an operating shaft 11 which will be described in detail hereinlater.

Figure 3:
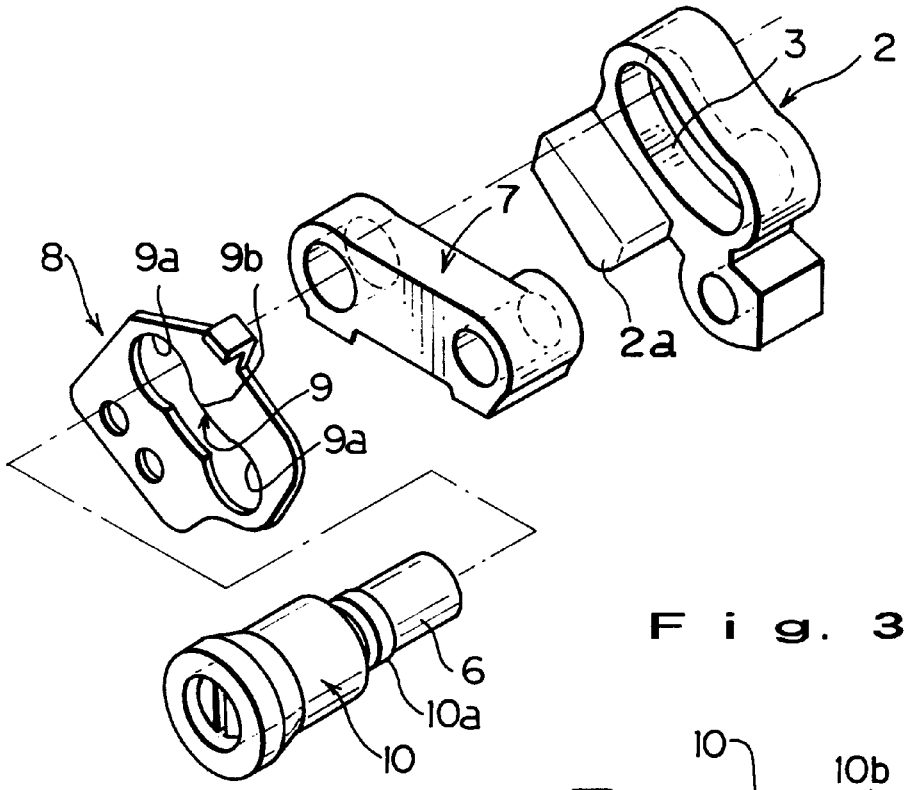
FIG. 3 (A) is an exploded perspective view of an essential part of the invention.
Figure 3:
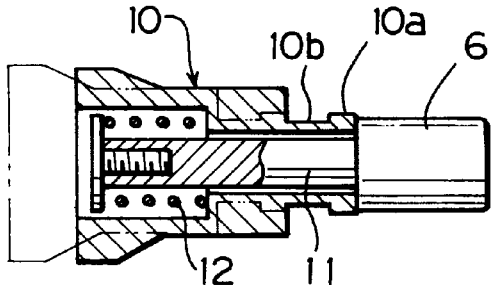
Figure 3:
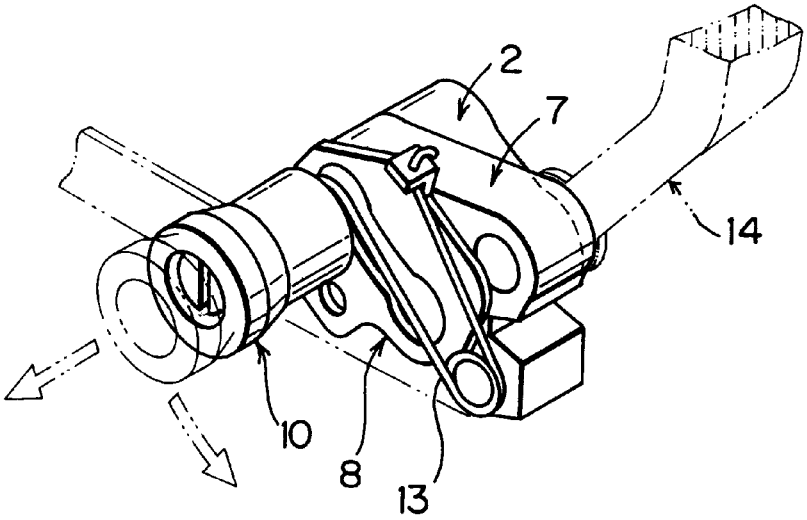
Figure 4:
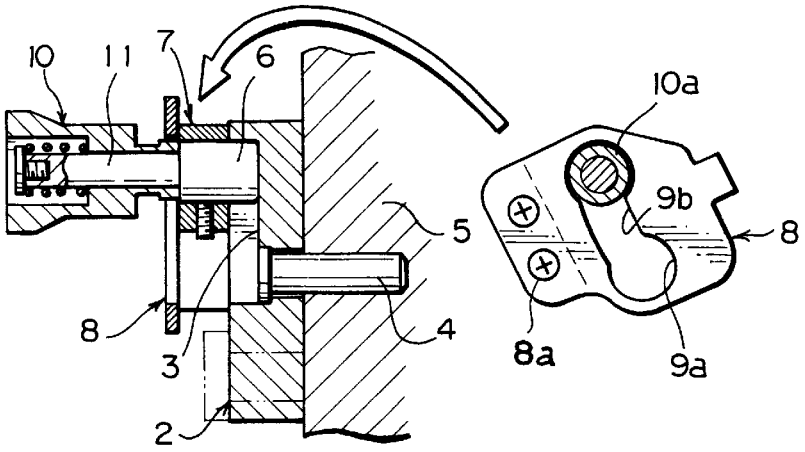
FIG. 4 (A) is a side elevational view of the essential part of FIG. 3(C) shown partly in cross section and showing one operation aspect thereof.
Figure 4:
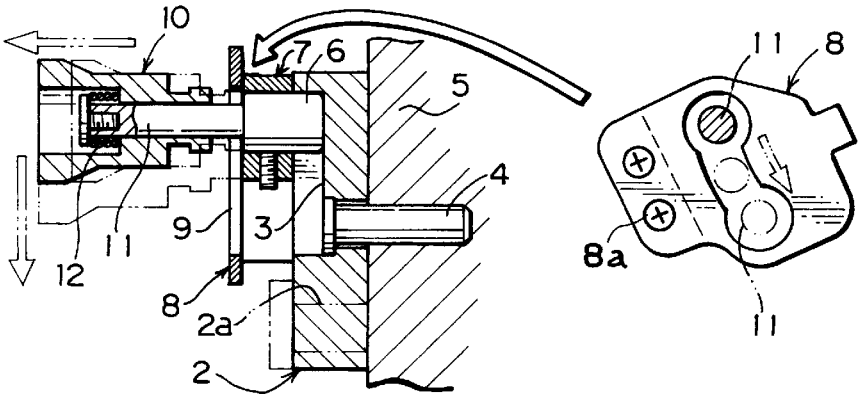
Figure 4:
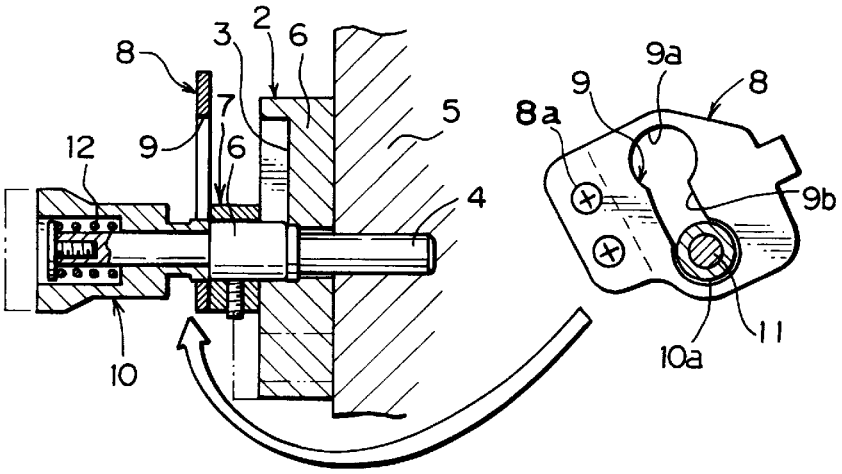

As particularly shown in FIG. 1(B), FIG. 3(A) and (C) and FIG. 4, a positioning plate 8 is secured to a part 2*a* of the swingable link 2 by means of screws 8*a*. The part 2*a* is axially extended from the swingable link 2 so that with the intermediate link 7 may be arranged between the positioning plate 8 and the swingable link 2. The positioning plate 8 has an arcuate guide slot 9 provided thereon which is substantially of the same shape with that of the guide groove 3 of the swingable link 2 and is axially in alignment with the guide groove 3 of the swingable link 2. The arcuate guide slot 9 is composed of an intermediate arcuate portion 9*b* and enlarged circular portions 9*a*, 9*a* provided at the opposite ends of the intermediate arcuate portion 9*b* respectively.

An operating shaft 11 extends through the guide slot 9 of the positioning plate 8 and has a radially enlarged portion 6 provided at one end thereof. The radially enlarged end portion 6 is positioned on the inner side of the positioning plate 8 and extends through the end of the link 7 which is opposite to the end thereof connected to the cutter drive link 14 and is further in engagement with the guide groove 3 of the swingable link 2.

Figure 2:
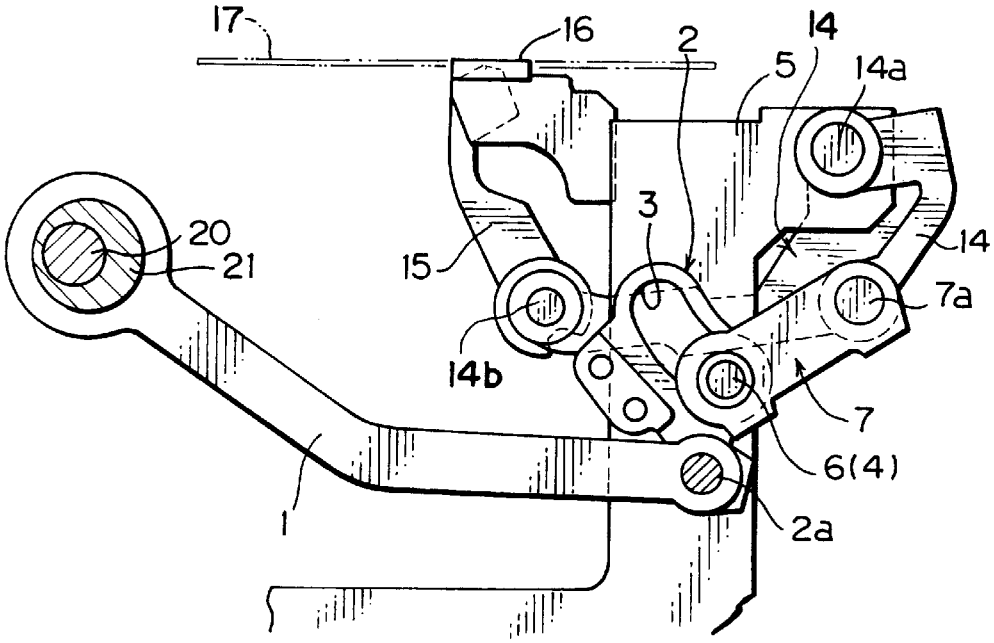
FIG. 2 (A) is a side elevational view of the essential part of the invention shown partly in cross section and showing an inoperative aspect thereof.
Figure 2:
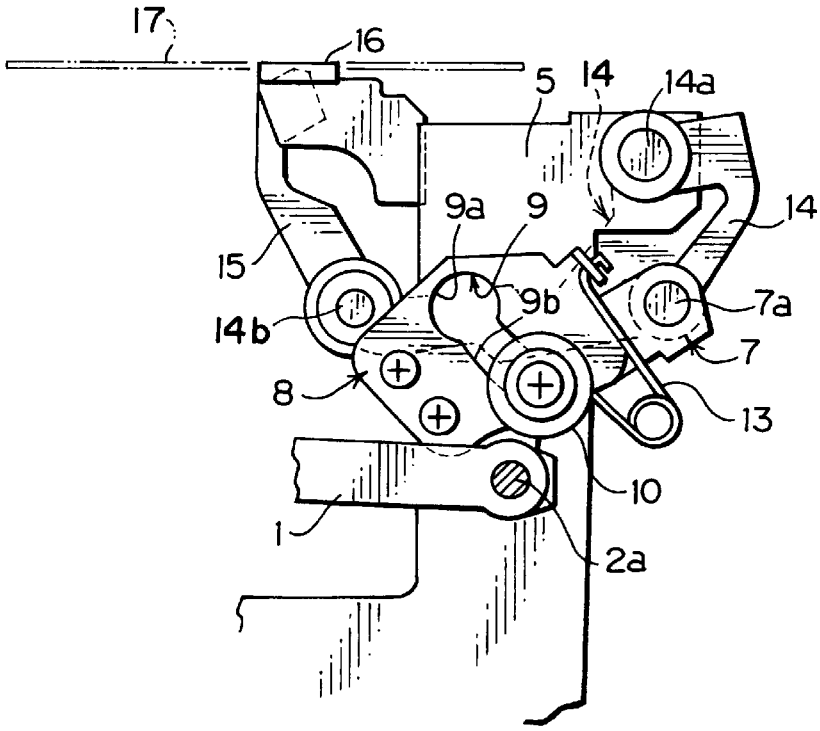

An operating knob 10 is mounted on the operating shaft 11 and is axially slidable thereon. The operating knob 10 has an axial extension terminated with a radially reduced portion 10*a* arranged axially in alignment with the radially enlarged end portion 6 of the operating shaft 11 as shown in FIG. 3(A)

and (B). The radially reduced portion 10*a* of the operating knob 10 is normally urged toward the radially enlarged end portion 6 of the operating shaft 11 by means of a compression spring 12 which is arranged between the operating knob 10 and the outer free end of the operating shaft 11 as shown in FIG. 3(B) and FIG. 4(A). The radially reduced portion 10*a* is pressed against the radially enlarged end portion 6 of the operating shaft 11 only through either of the enlarged circular portions 9*a*, 9*a* of the guide slot 9 of the positioning plate 8 as shown in FIG. 4(A) and FIG. 4(C) wherein the radially reduced portion 10*a*, that is, the operating knob 10 is held in either of the enlarged circular portions 9*a*, 9*a* of the guide slot 9 of the positioning plate 8 by the action of a torsion spring 13 which has one end anchored to a part of the positioning plate 8 and the opposite end connected to an intermediate radially reduced portion 10*b* of the operating knob 10 as shown in FIG. 3(C) and FIG. 2(B).

The movable cutter 15 is vertically reciprocated in association with the swinging movement of the cutter drive link 14 around the swing axis 14*a*, which is generated by the lateral reciprocation of the transmission link 1 which is transmitted to the cutter drive link 14 by way of the swingable link 2 and the intermediate link 7. The movable cutter 15 is thus vertically reciprocated to cut a work (not shown), while the latter is being stitched, in cooperation with the fixed cutter 16 which is fixedly provided adjacent to the movable cutter 15 on the same plane of a needle plate 17 which has a needle hole (not shown) through which a machine needle 18 is vertically reciprocated in association with rotation of the main drive shaft 20.

FIG. 1(A) shows that the upper edge portion of the movable cutter 15 is protruded above the plane of the needle plate 17 while the radially enlarged end portion 6 of the operating shaft 11 is positioned at the upper end of the guide groove 3 of the swingable link 2. This condition corresponds to FIG. 4(A) wherein the radially reduced portion 10*a* of the operating knob 10 is positioned in engagement with the upper enlarged circular portion 9*a* of the guide slot 9 of the positioning plate 8 and is held there by the spring action of the torsion spring 13, and therefore the end portion 6 of the operating shaft 11 is held at the upper end of the guide groove 3 of the swingable link 2.

In this condition, if the main drive shaft 20 is rotated, the transmission link 1 is laterally reciprocated due to the rotation of the eccentric cam 21. The lateral reciprocation of the transmission link 1 causes the swingable link 2 to swing around the central axis 4 thereof. The swinging movement of the swingable link 2 is transmitted to the cutter drive link 14 by way of the intermediate link 7. The cutter drive link 14 is, therefore, swingingly reciprocated around the axis 14*a*. As the result, the movable cutter 15 is vertically reciprocated between the position as shown in FIG. 1(A) wherein the upper edge portion of the movable cutter 15 is positioned above the plane of the needle plate 17 and the position as shown in FIG. 1(B) wherein the upper edge portion of the cutter 15 is positioned partly below the plane of the needle plate 17. Thus the movable cutter 15 is brought into cooperation with the fixed cutter 16 to cut the work while the latter is being stitched.

The radially enlarged end portion 6 of the operating shaft 11 may be moved from the upper end of the guide groove 3 of the swingable link 2 to the lower end of the guide groove 3 thereof where there is the swing axis 4 of the swingable link 2 as shown in FIG. 2(A). Precisely if the operating knob 10 is pulled toward the machine user against the spring action of the compression spring 12, the radially reduced portion 10*a* of the knob 10 is axially disengaged from the upper enlarged circular portion 9*a* of the guide slot 9 of the positioning plate 8 as shown in FIG. 4(B). Subsequently the operating knob 10 is moved down until the radially enlarged end portion 6 of the operating shaft 11 comes to the swing axis 4 at the lower end of the guide groove 9 of the swingable link 2 and is stopped there as shown in FIG. 4(C) while the cutter drive link 14 is slightly rotated around the axis 14*a* in the counterclockwise direction in FIG. 2(A) until the upper edge portion of the movable cutter 15 is moved down to below the plane of the upper surface of the needle plate 17 as shown in FIG. 2(A). Then the operating knob 10 is released. As the result, the radially reduced portion 10*a* of the knob 10 is axially moved back and engages the lower enlarged circular portion 9*a* of the guide slot 9 of the positioning plate 8 by the spring action of the compression spring 12 and is held there by the spring action of the torsion spring 13.

In the same way, the radially enlarged end portion 6 of the operating shaft 11 may be moved to the upper end of the guide groove 3 of the swingable link 2 from the central swing axis 4 thereof.

In the condition as shown in FIG. 4(C), if the main drive shaft 20 is rotated, the transmission link 1 is laterally reciprocated. The lateral reciprocation of the transmission link 1 causes the swingable link 2 to swing around the swing axis 4. However the swinging movement of the swingable link 2 is not transmitted to the link intermediate link 7 because the radially enlarged end portion 6 of the operating shaft 11 is axially in alignment with the swing axis 4 of the swingable link 2. Therefore the cutter drive link 14 remains standstill. As the result, the movable cutter 15 is held at the lower position below the plane of the upper surface of the needle plate 17 as shown in FIG. 2(A) and (B).

Thus the movable cutter 15 may be held motionless at the lower inoperative position below the plane of the needle plate 17 when the work is stitched while the latter is not being cut.

The invention being thus described, it will be obvious that the same may be varied in many ways. Such variations are not regarded as a departure from the spirit and scope of the invention, and all such modifications are intended to be included within the scope of the following claims.

What is claimed is:

1. An overlook sewing machine having a movable cutter which is activated in association with rotation of a main drive shaft to cooperate with a fixed cutter provided in the same plane with an upper surface of a needle plate, to thereby cut a work while the work is being stitched, said overlook sewing machine comprising:

a drive link having one end swingably connected to a fixed mount and an opposite end connected to said movable cutter;

a swingable link having opposite ends and a central axis between said opposite ends, around which said swingable link is swingable, said swingable link having an arcuate guide groove extending between said central axis and one of said opposite ends thereof;

reciprocation movement generating means including an eccentric cam secured to said main drive shaft for rotation therewith and a transmission link having one end engaging said eccentric cam and the opposite end connected to the other of said opposite ends of said swingable link, thereby to normally swing said swingable link around said central axis thereof as said main drive shaft is rotated;

an intermediate link having opposite ends, one of which is turnably connected to a central part between said opposite ends of said drive link;

operating means including an operating shaft having one end portion extending through the other of said opposite ends of said intermediate link and being in engagement with said arcuate guide groove of said swingable link, said operating means further including an operating knob mounted on said operating shaft, said operating knob operated to move said one end portion of said operating shaft alone said arcuate guide groove of said swingable link, thereby to move said other end of said intermediate link between said central axis and said one end of said swingable link, said intermediate link enabling said drive link to swingingly reciprocate to activate said movable cutter when said other end of said intermediate link is moved to said one end of said swingable link, said intermediate link rotatingly move said drive link to move said movable cutter to an inoperative position below said needle plate where said movable cutter is held at standstill when said other end of said intermediate link is moved to said central axis of the swingable;

further comprising positioning means including a positioning plate secured to said swingable link and having a guide slot provided thereon, said guide slot being substantially of the same shape with that of said guide groove of said swingable link and having opposite enlarged circular portions provided at the opposite ends thereof and being axially in alignment with said guide groove of said swingable link, so that said operating knob may be operated to engage either of said opposite enlarged circular portions to position said other end of said intermediate link at either of said opposite ends of said guide groove of said swingable link.

2. The overlock sewing machine as defined in claim 1, wherein said positioning means further includes a torsion spring having one end anchored to a part of said positioning plate and the opposite end connected to said operating knob to hold said operating knob at either of said opposite enlarged circular portions of said guide slot of said positioning plate.

3. The overlock sewing machine as defined in claim 1, wherein said operating knob is axially movable on said operating shaft and is normally urged toward said positioning plate by means of a compression spring, said operating knob being pulled against the spring action of said compression spring to be disengaged from either of said opposite enlarged circular portions and operated in a plane parallel with said positioning plate to move said operating shaft along said arcuate guide slot between said opposite enlarged circular portions at the opposite ends thereof.

4. The overlock sewing machine as defined in claim 1, wherein said operating knob is axially movable on said operating shaft and is normally urged toward said positioning plate by means of a compression spring, said operating knob being pulled against the spring action of said compression spring to be disengaged from either of said opposite enlarged circular portions and operated in a plane parallel with said positioning plate to move said operating shaft along said arcuate guide slot between said opposite enlarged circular portions at the opposite ends thereof.

5. An overlook sewing machine having a movable cutter which is activated in association with rotation of a main drive shaft to cooperate with a fixed cutter provided in the same plane with an upper surface of a needle plate, to thereby cut a work while the work is being stitched, said overlook sewing machine comprising:

a drive link having one end swingably connected to a fixed mount and an opposite end connected to said movable cutter;

a swingable link having opposite ends and a central axis between said opposite ends, around which said swingable link is swingable, said swingable link having an arcuate guide groove extending between said central axis and one of said opposite ends thereof;

a reciprocation movement generator including an eccentric cam secured to said main drive shaft for rotation therewith and a transmission link having one end engaging said eccentric cam and the opposite end connected to the other of said opposite ends of said swingable link, thereby to normally swing said swingable link around said central axis thereof as said main drive shaft is rotated;

an intermediate link having opposite ends, one of which is turnably connected to a central part between said opposite ends of said drive link;

an operating shaft having one end portion extending through the other of said opposite ends of said intermediate link and being in engagement with said arcuate guide groove of said swingable link, further including an operating knob mounted on said operating shaft, said operating knob operated to move said one end portion of said operating shaft along said arcuate guide groove of said swingable link, thereby to move said other end of said intermediate link between said central axis and said one end of said swingable link, said intermediate link enabling said drive link to swingingly reciprocate to activate said movable cutter when said other end of said intermediate link is moved to said one end of said swingable link, said intermediate link rotatingly move said drive link to move said movable cutter to an inoperative position below said needle plate where said movable cutter is held at standstill when said other end of said intermediate link is moved to said central axis of the swingable;

further including a positioning plate secured to said swingable link and having a guide slot provided thereon, said guide slot being substantially of the same shape with that of said guide groove of said swingable link and having opposite enlarged circular portions provided at the opposite ends thereof and being axially in alignment with said guide groove of said swingable link, so that said operating knob may be operated to engage either of said opposite enlarged circular portions to position said other end of said intermediate link at either of said opposite ends of said guide groove of said swingable link.

* * * * *